US006943733B2

(12) United States Patent
Vance

(10) Patent No.: US 6,943,733 B2
(45) Date of Patent: Sep. 13, 2005

(54) MULTI-BAND PLANAR INVERTED-F ANTENNAS INCLUDING FLOATING PARASITIC ELEMENTS AND WIRELESS TERMINALS INCORPORATING THE SAME

(75) Inventor: Scott L. Vance, Cary, NC (US)

(73) Assignee: Sony Ericsson Mobile Communications, AB, Lund (SE)

( * ) Notice: Subject to any disclaimer, the term of this patent is extended or adjusted under 35 U.S.C. 154(b) by 11 days.

(21) Appl. No.: 10/699,048

(22) Filed: Oct. 31, 2003

(65) Prior Publication Data

US 2005/0093750 A1 May 5, 2005

(51) Int. Cl.[7] ..... H01Q 1/24
(52) U.S. Cl. ..... 343/700 MS; 343/702
(58) Field of Search ..... 343/702, 700 MS, 343/893

(56) References Cited

U.S. PATENT DOCUMENTS

| | | | | | |
|---|---|---|---|---|---|
| 6,166,694 | A | * | 12/2000 | Ying | 343/702 |
| 6,429,818 | B1 | * | 8/2002 | Johnson et al. | 343/702 |
| 6,456,249 | B1 | * | 9/2002 | Johnson et al. | 343/702 |
| 6,552,686 | B2 | * | 4/2003 | Ollikainen et al. | 343/700 MS |
| 6,573,869 | B2 | * | 6/2003 | Moore | 343/702 |
| 6,639,560 | B1 | * | 10/2003 | Kadambi et al. | 343/700 MS |
| 6,734,825 | B1 | * | 5/2004 | Guo et al. | 343/700 MS |
| 6,759,989 | B2 | * | 7/2004 | Tarvas et al. | 343/700 MS |
| 6,788,257 | B2 | * | 9/2004 | Fang et al. | 343/700 MS |
| 6,795,028 | B2 | * | 9/2004 | Stutzman et al. | 343/702 |
| 6,831,607 | B2 | * | 12/2004 | Hebron et al. | 343/700 MS |
| 6,876,329 | B2 | * | 4/2005 | Milosavljevic | 343/700 MS |
| 2001/0048391 | A1 | * | 12/2001 | Annamaa et al. | 343/700 MS |
| 2001/0050643 | A1 | * | 12/2001 | Egorov et al. | 343/702 |
| 2002/0070902 | A1 | * | 6/2002 | Johnson et al. | 343/702 |
| 2002/0075187 | A1 | * | 6/2002 | McKivergan | 343/702 |
| 2003/0098812 | A1 | * | 5/2003 | Ying et al. | 343/702 |
| 2003/0160728 | A1 | * | 8/2003 | Fukushima et al. | 343/702 |
| 2004/0178958 | A1 | * | 9/2004 | Kadambi et al. | 343/700 MS |
| 2004/0198293 | A1 | * | 10/2004 | Sadler et al. | 455/280 |
| 2004/0207559 | A1 | * | 10/2004 | Milosavljevic | 343/702 |
| 2004/0212545 | A1 | * | 10/2004 | Li et al. | 343/866 |
| 2005/0024272 | A1 | * | 2/2005 | Ponce De Leon et al. | 343/702 |

FOREIGN PATENT DOCUMENTS

| | | | | |
|---|---|---|---|---|
| EP | 1 128 466 A2 | * | 1/2001 | H01Q/9/04 |
| EP | 1 128 466 | * | 1/2001 | H01Q/9/04 |
| EP | 1 128 466 A2 | | 8/2001 | |
| EP | 1 291 968 A1 | | 3/2003 | |
| EP | 1 351 334 A1 | * | 4/2003 | H01Q/9/04 |
| EP | 1 351 334 A1 | | 10/2003 | |

OTHER PUBLICATIONS

International Search Report corresponding to PCT/US2004/033416, Jan. 13, 2005).

* cited by examiner

*Primary Examiner*—Don Wong
*Assistant Examiner*—Leith Al-Nazer
(74) *Attorney, Agent, or Firm*—Myers Bigel Sibley & Sajovec, P.A.

(57) ABSTRACT

A multi-band planar inverted-F antenna includes a floating parasitic element. For example, a planar inverted-F antenna includes first and second planar inverted-F antenna branches that extend on a dielectric substrate. The first planar inverted-F antenna branch is configured to resonate in response to first electromagnetic radiation in a first frequency band. The second planar inverted-F antenna branch is configured to resonate in response to second electromagnetic radiation in a second frequency band. The floating parasitic element is configured to electromagnetically couple to the second planar inverted-F antenna branch when, for example, the second planar inverted-F antenna branch is excited by the electromagnetic radiation provided via an RF feed (when the antenna is used to transmit). The floating parasitic element is also configured to electromagnetically couple to the second planar inverted-F antenna branch when the floating parasitic element is excited by electromagnetic radiation provided via free-space.

25 Claims, 5 Drawing Sheets

MULTI-BAND PLANAR INVERTED-F ANTENNAS INCLUDING FLOATING PARASITIC ELEMENTS AND WIRELESS TERMINALS INCORPORATING THE SAME

FIELD OF THE INVENTION

The invention generally relates to the field of communications, and more particularly, to antennas and wireless terminals incorporating the same.

BACKGROUND OF THE INVENTION

Many contemporary wireless terminals, such as cell phones, are less than 11 centimeters in length. Thus, there is an interest in antennas that can be mounted inside these types of wireless terminals. A planar antenna, such as an planar inverted-F antenna, is one type of antenna that may be well suited for use within the confines of small wireless terminals. Typically, conventional inverted-F antennas include a conductive element that is spaced apart from a ground plane. Exemplary inverted-F antennas are described, for example, in U.S. Pat. Nos. 6,639,560 and 6,573,869, the disclosures of which are incorporated herein by reference in their entireties.

Wireless terminals may operate in multiple frequency bands in order to provide operations in multiple communications systems. For example, many cellular telephones are now designed for dual-band or triple-band operation in GSM and CDMA modes at nominal frequencies of 850 MHz, 900 MHz, 1800 MHz and/or 1900 MHz. Digital Communications System (DCS) is a digital mobile telephone system that typically operates in a frequency band between 1710 MHz and 1850 MHz. The frequency bands allocated for mobile terminals in North America also include 824–894 MHz for Advanced Mobile Phone Service (AMPS) and 1850–1990 MHz for Personal Communication Services (PCS). Depending on the location, a wireless terminal may support communications in two or more of these frequency bands, which is referred to herein as multi-band operations.

Many of the conventional antennas discussed above include a Radio Frequency (RF) "feed" and a ground contact so that a transceiver in the wireless terminal can transmit and receive radio signals in each of the supported frequency bands via the antenna. In some conventional multi-band antenna configurations, it is known to separate the RF feed from ground contact by about 2–3 mm for operation in a low frequency band (e.g., 824–894 MHz.) whereas operations in a high frequency band may require that the RF feed and the ground contact be spaced-apart by distances greater than 2–3 mm. In some multi-band antenna configurations, it is known to space the RF feed and the ground contact apart by about 7–11 mm as a compromise between high and low frequency band performance.

Some conventional multi-band antenna configurations include a grounded parasitic element. Such an approach may require at least one additional contact (i.e. in addition to the RF feed and ground contacts discussed above) to ground, which may require additional space in the wireless terminal to accommodate the antenna. This may decrease the available area for placement of other components within the housing of the wireless terminal.

SUMMARY

Embodiments according to the invention provide multi-band planar inverted-F antennas that include a floating parasitic element. Pursuant to these embodiments, a multi-band antenna can include a first planar inverted-F antenna branch configured to resonate in response to first electromagnetic radiation in a first frequency band. A second planar inverted-F antenna branch that can be configured to resonate in response to second electromagnetic radiation in a second frequency band that is less than the first frequency b. A floating parasitic element can be spaced apart from and ohmically isolated from the second planar inverted-F antenna branch and electromagnetically coupled thereto.

In some embodiments according to the invention, the floating parasitic element is coplanar with the second planar inverted-F antenna branch. In some embodiments according to the invention, the floating parasitic element is beneath and at least partially overlaps the second planar inverted-F antenna branch. In some embodiments according to the invention, the floating parasitic element is above and at least partially overlaps the second planar inverted-F antenna branch.

In some embodiments according to the invention, the multi-band antenna can further include a ground plane, wherein the floating parasitic element is located between the ground plane and the second planar inverted-F antenna branch. In some embodiments according to the invention, the first and second planar inverted-F antenna branches extend in a first direction to partially enclose an open region. In some embodiments according to the invention, the second planar inverted-F antenna branch is between the floating parasitic element and the open region. In some embodiments according to the invention, the second planar inverted-F antenna branch extends in first and second directions and the floating parasitic element extends in the first and second directions.

In some embodiments according to the invention, the first planar inverted-F antenna branch is configured to provide a first signal component in a first frequency range of the first frequency band. The floating parasitic element is configured to resonate to provide a second signal component in the first frequency band in a second frequency range in the first frequency band that overlaps the first frequency range to provide a bandwidth for the multi-band antenna assembly in the first frequency range.

In some embodiments according to the invention, the multi-band antenna can further include a dielectric substrate having the first and second planar inverted-F antenna branches mounted thereon. The first and second planar inverted-F antenna branches are coupled to one another at a proximal portion of the dielectric substrate.

In some embodiments according to the invention, the multi-band antenna can further include an RF feed coupled to the first and second planar inverted-F antenna branches at the proximal portion of the dielectric substrate. A ground contact is coupled to the proximal portion spaced apart from the RF feed.

In further embodiments according to the invention, a multi-band wireless terminal can include a housing and a receiver, positioned within the housing, that receives multi-band wireless communications signals and/or a transmitter that transmits multi-band wireless communications signals. The multi-band wireless terminal can further include a multi-band antenna with a first planar inverted-F antenna branch configured to resonate in response to first electromagnetic radiation in a first frequency band. A second planar inverted-F antenna branch included in the multi-band antenna is configured to resonate in response to second electromagnetic radiation in a second frequency band that is less than the first frequency band. A floating parasitic element in the multi-band antenna is spaced apart from and ohmically isolated from the second planar inverted-F antenna branch and electromagnetically coupled thereto.

DESCRIPTION OF EMBODIMENTS ACCORDING TO THE INVENTION

Figure 1:
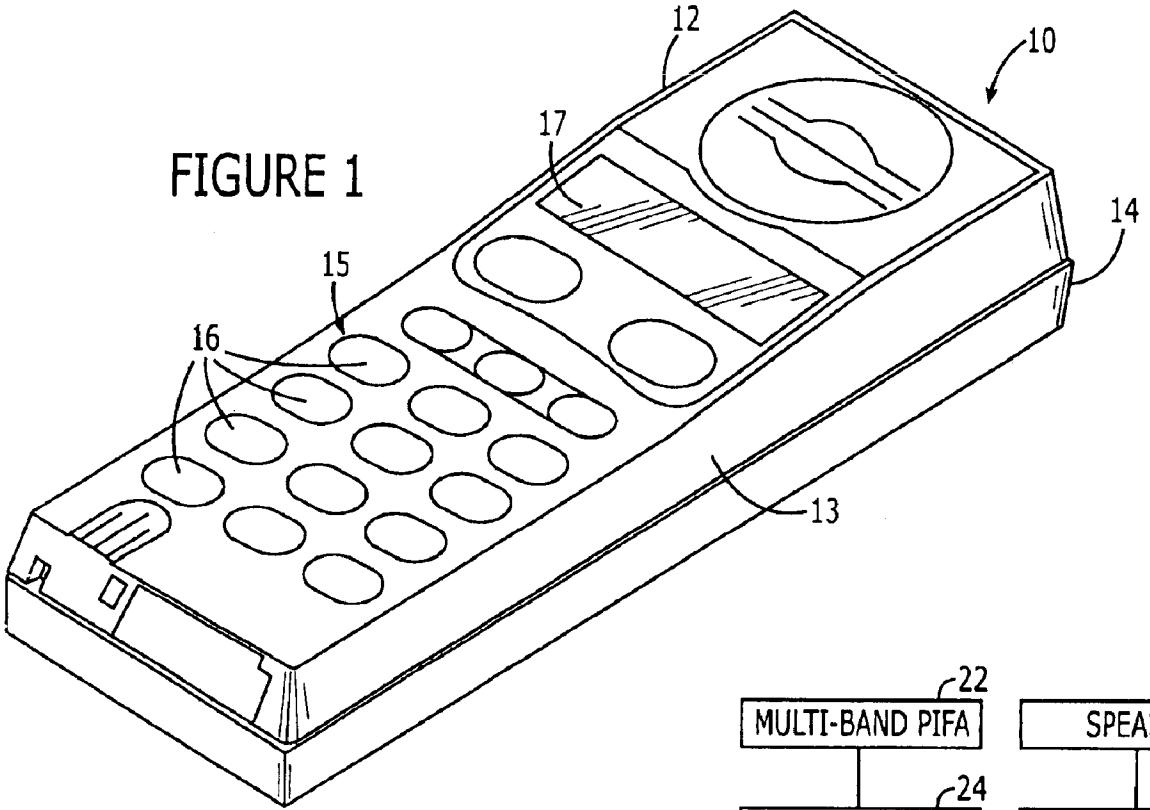
FIG. 1 is a schematic diagram that illustrates some embodiments of wireless terminals according to the invention.

The invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the thickness of lines, layers and regions may be exaggerated for clarity. It will be understood that when an element, such as a layer, region or substrate, is referred to as being "on" another element, it can be directly on the other element or intervening elements may also be present. In contrast, when an element is referred to as being "directly on" another element, there are no intervening elements present. It will also be understood that, when an element is referred to as being "connected" or "coupled" to another element, it can be directly connected to the other element or intervening elements may be present. In contrast, when an element is referred to as being "directly connected" or "directly coupled" to another element, there are no intervening elements present. Like numbers refer to like elements throughout.

In addition, spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

As used herein, the term "wireless terminal" may include, but is not limited to, a cellular wireless terminal with or without a multi-line display; a Personal Communications System (PCS) terminal that may combine a cellular wireless terminal with data processing, facsimile and data communications capabilities; a PDA that can include a wireless terminal, pager, Internet/intranet access, Web browser, organizer, calendar and/or a global positioning system (GPS) receiver; and a conventional laptop and/or palmtop receiver or other appliance that includes a wireless terminal transceiver. Wireless terminals may also be referred to as "pervasive computing" devices and may be mobile terminals.

Although embodiments of multi-band antennas according to the invention are described herein with respect to wireless terminals, the invention is not so limited. For example, embodiments of multi-band antennas according to the invention may be used within wireless communicators that may only transmit or only receive wireless communications signals. For example, conventional AM/FM radios or any receiver utilizing an antenna may only receive communications signals. Alternatively, remote data generating devices may only transmit communications signals.

Multi-band antennas including floating parasitic elements according to embodiments of the invention may be incorporated into a wireless terminal 10 illustrated in FIG. 1. The wireless terminal 10 includes a top housing portion 13 and a bottom housing portion 14 that are coupled together to form a housing 12 including a cavity therein. The top and bottom housing portions 13, 14 house a keypad 15, which may include a plurality of keys 16, a display 17, and electronic components (not shown) that enable the wireless terminal 10 to transmit and receive communications signals to operate in multiple communications systems.

It will be understood that embodiments of multi-band antennas according to the invention can be included in the cavity defined by the housing 12. It will also be understood that, although embodiments of multi-band antennas according to the invention are described herein as included in the cavity, embodiments of multi-band antennas according to the invention may also be located outside the housing. In such embodiments, for example, a multi-band antenna may be mounted on the bottom housing portion 13 and can be electromagnetically coupled to an another antenna in the cavity through the housing 12. Such external multi-band antennas according to embodiments of the invention may be provided as add-on attachments after an initial sale (or other arrangement) of the wireless terminal to a subscriber.

Figure 2:
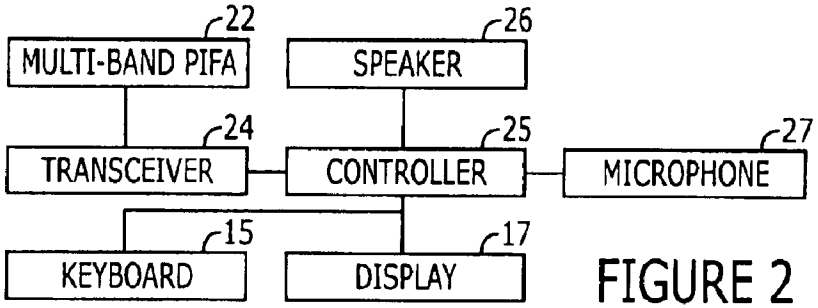
FIG. 2 is a block diagram that illustrates some embodiments of wireless terminals including multi-band antennas according to the invention.

Referring now to FIG. 2, an arrangement of electronic components that enable a wireless terminal 10 to transmit and receive communication signals will be described in further detail. As illustrated, a multi-band planar inverted F-antenna 22 for receiving and/or transmitting Radio Frequency (RF) signals is electrically coupled to an RF transceiver 24 that is further electrically coupled to a controller 25, such as a microprocessor. The controller 25 is electrically coupled to a speaker 26 that is configured to transmit an audible signal to a user of a wireless terminal based on data provided, for example, by the controller 25. The controller 25 is also electrically coupled to a microphone 27 that is configured to receive audio input from a user and provide the input to the controller 25 and transceiver 24 for transmission to a remote device. The controller 25 is electrically coupled to the keypad 15 and the display 17 to facilitate user input/output of data related to wireless terminal operations.

It will be understood by those skilled in the art that the multi-band antenna 22 may be used for transmitting and/or receiving electromagnetic radiation (in the form of an RF signal) to/from the wireless terminal 10 to support communications in multiple frequency bands. In particular, during transmission, the multi-band antenna 22 resonates in response to signals received from a transmitter portion of the transceiver 24 and radiates corresponding RF electromagnetic radiation into free-space. During reception, the multi-band antenna 22 resonates responsive to RF electromagnetic radiation received via free-space and provides a corresponding signal to a receiver portion of the transceiver 24.

To facilitate effective performance during transmission and reception, the impedance of the multi-band antenna 22 can be "matched" to an impedance of the transceiver 24 to maximize power transfer between the multi-band antenna 22 and the transceiver 24. It will be understood that, as used herein, the term "matched" includes configurations where the impedances are substantially electrically tuned to compensate for undesired antenna impedance components to provide a particular impedance value, such as 50-Ohms (Ω), at a feed point of the multi-band antenna 22.

Figure 3:
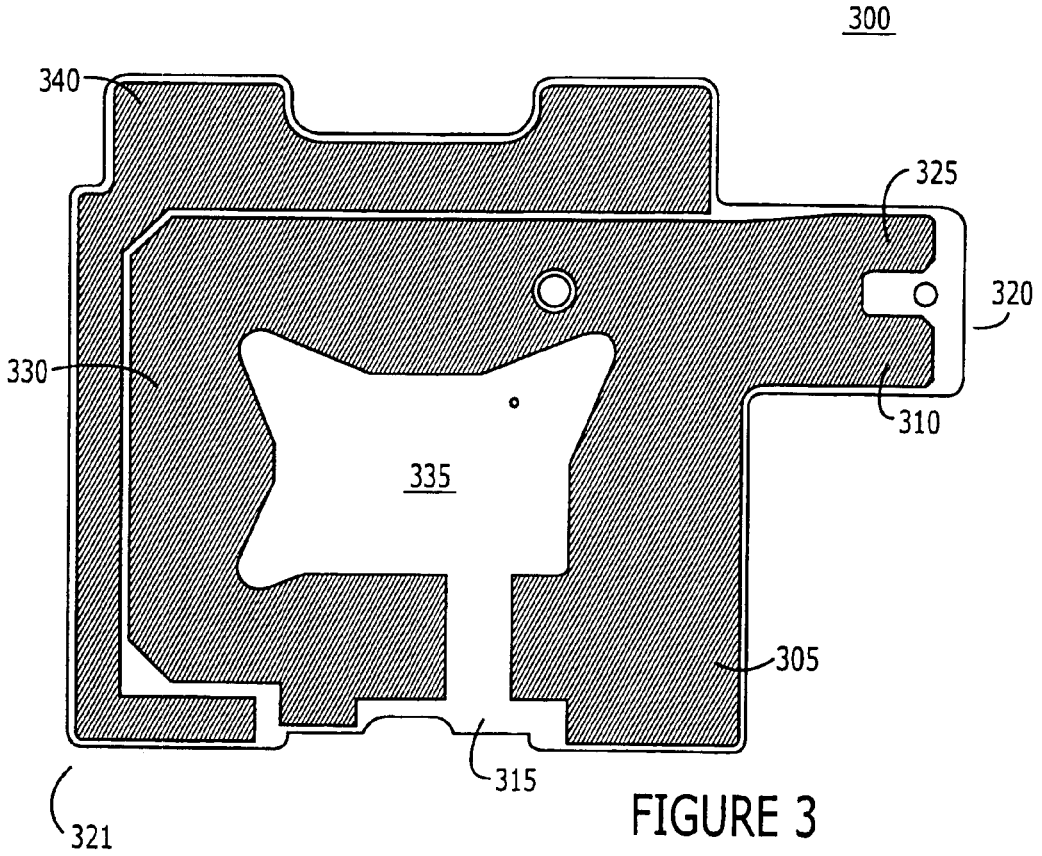
FIG. 3 is a plan view that illustrates some embodiments of multi-band planar inverted-F antennas according to the invention.

In some embodiments according to the invention, the multi-band antenna 22 can be can be a multi-band planar inverted-F antenna (PIFA) including a floating parasitic element. For example, as shown in FIG. 3, a multi-band planar inverted-F antenna 300 includes a first planar inverted-F antenna branch 305 that extends substantially in a first direction on a dielectric substrate 315 away from a proximal portion 320 of the dielectric substrate 315 toward a distal portion 321 of the of the dielectric substrate 315. The first planar inverted-F antenna branch 305 is configured to resonate in response to first electromagnetic radiation in a first frequency band. In some embodiments according to the invention, the first frequency band can include frequencies in a range between about 1710 MHz and about 1990 MHz.

A second planar inverted-F antenna branch 330 extends substantially in a second direction away from the proximal portion 320 a first distance and extends a second distance in the first direction (substantially parallel to the first planar inverted-F antenna branch 305) toward the distal portion 321. As shown, the second planar inverted-F antenna branch 330 also extends in a third direction (opposite the second direction) away from the distal portion 321. The second planar inverted-F antenna branch 330 resonates in response to second electromagnetic radiation in a second frequency band that is less than the first frequency band. In some embodiments according to the invention, the second frequency band can include frequencies in a range between about 824 MHz and about 960 MHz. The first and second planar inverted-F antenna branches 305, 330 define an open region 335 therebetween.

Electromagnetic radiation to be transmitted via the planar inverted-F antenna 300 can be provided thereto via an RF feed 310 located on the proximal portion 320 of the dielectric substrate 315. A ground contact 325 can also be located on the proximal portion 320 of the dielectric substrate 315 spaced apart from the RF feed 310.

As shown in FIG. 3, the multi-band planar inverted-F antenna 300 also includes a floating parasitic element 340 that extends in the first, second, and third directions on the dielectric substrate 315 and substantially follows an outer contour of the second planar inverted-F antenna branch 330. The floating parasitic element 340 is spaced apart from the first and second planar inverted-F antenna branches 305, 330.

It will be understood that, as used herein, the term "floating" (in reference to the floating parasitic element 340) includes configurations where the parasitic element is electrically isolated from (or electrically floats relative to) a ground plane associated with the multi-band antenna 300. It will be understood that the term "ground plane", as used herein, is not limited to the form of a plane. For example, the "ground plane" may be a strip or any shape or reasonable size.

In some embodiments according to the invention, the floating parasitic element 340 and the second planar inverted-F antenna branch 330 are separated by a spacing that is generally less than 1.5% of the wave length of the RF electromagnetic radiation include in the first frequency band. In some embodiments according to the invention where the floating parasitic element 340 is coplanar with the second planar inverted-F antenna branch 330, the spacing between the two components can be less than about 1.0 mm. In some embodiments according to the invention, the floating parasitic element 340 extends in the first and second directions and follows an outer contour of the second planar inverted-F antenna branch 330.

The floating parasitic element 340 is ohmically isolated from the first and second planar inverted-F antenna branches 305, 330 and is configured to electromagnetically couple to the second planar inverted-F antenna branch 330 when, for example, the second planar inverted-F antenna branch 330 is excited by the electromagnetic radiation provided via the RF feed 310 by induction. Furthermore, the floating parasitic element 340 is configured to electromagnetically couple to the second planar inverted-F antenna branch 330 when the floating parasitic element 340 is excited by the electromagnetic radiation provided via free-space.

As used herein, the term "ohmically" refers to configurations where an impedance between two elements is substantially given by the relationship of Impedance=V/I, where V is a voltage across the two elements and I is the current therebetween, at substantially all frequencies (i.e., the impedance between ohmically coupled elements is substantially the same at all frequencies. Therefore, the phrase "ohmically isolated" refers to configurations where the impedance between two elements is substantially infinite at relatively low frequency (such as DC). However, it will be understood that although the two elements may be ohmically isolated, the impedance between the two elements can be a function of frequency where, for example, the elements are capacitively coupled to one another. For example, two elements directly coupled together by a metal conductor are not ohmically isolated from one another. In contrast, two elements that are electrically coupled to one another only by a capacitive effect are ohmically isolated from one another and electromagnetically coupled to one another.

In some embodiments according to the invention, the floating parasitic element 340 is configured to resonate to provide a component of a signal in a first frequency range included in the first frequency band described above. Furthermore, the floating parasitic element 340 operates in conjunction with the first planar inverted-F antenna branch 305 which resonates to provide another component of the signal in a second frequency range also included in the first frequency band. In particular, the resonance of the floating parasitic element 340 can be electromagnetically coupled to the first planar inverted-F antenna branch via the second planar inverted-F antenna branch to provide operation in the first frequency band.

The first and second components of the signal can be combined to provide a Voltage Standing Wave Ratio (VSWR or SWR) for the multi-band antenna 300 in the first frequency band in a range between about 2.5 and about 1.0. A VSWR associated with the multi-band antenna 22 relates to the impedance match of the multi-band antenna 22 feed with a feed line or transmission line of the wireless terminal. To radiate electromagnetic RF radiation with a minimum loss, or to provide received RF radiation to the transceiver in the wireless terminal with minimum loss, the impedance of the multi-band antenna 300 is matched to the impedance of the transmission line or feed point via which electromagnetic RF radiation is provided to/from the multi-band antenna 300.

It will be understood by those of skill in the art that the antenna branches 305, 330, may be formed on a dielectric substrate of FR4 or polyimide, by etching a metal layer or layers in a pattern on the dielectric substrate. The antenna branches 305, 330 can be formed of a conductive material such as copper. For example, the antenna branches may be formed from a copper sheet. Alternatively, the antenna branches 305, 330 may be formed from a copper layer on the dielectric substrate. It will be understood that planar inverted-F antenna branches according to the invention may be formed from other conductive materials and are not limited to copper.

Multi-band planar inverted-F antennas 300 according to embodiments of the invention may have various shapes, configurations, and/or sizes and are not limited to those illustrated. For example, the invention may be implemented with any micro-strip antenna. Moreover, embodiments of the present invention are not limited to planar inverted-F antennas having two branches. For example, planar Inverted-F antennas according to embodiments of the invention may more than two branches.

Figure 4:
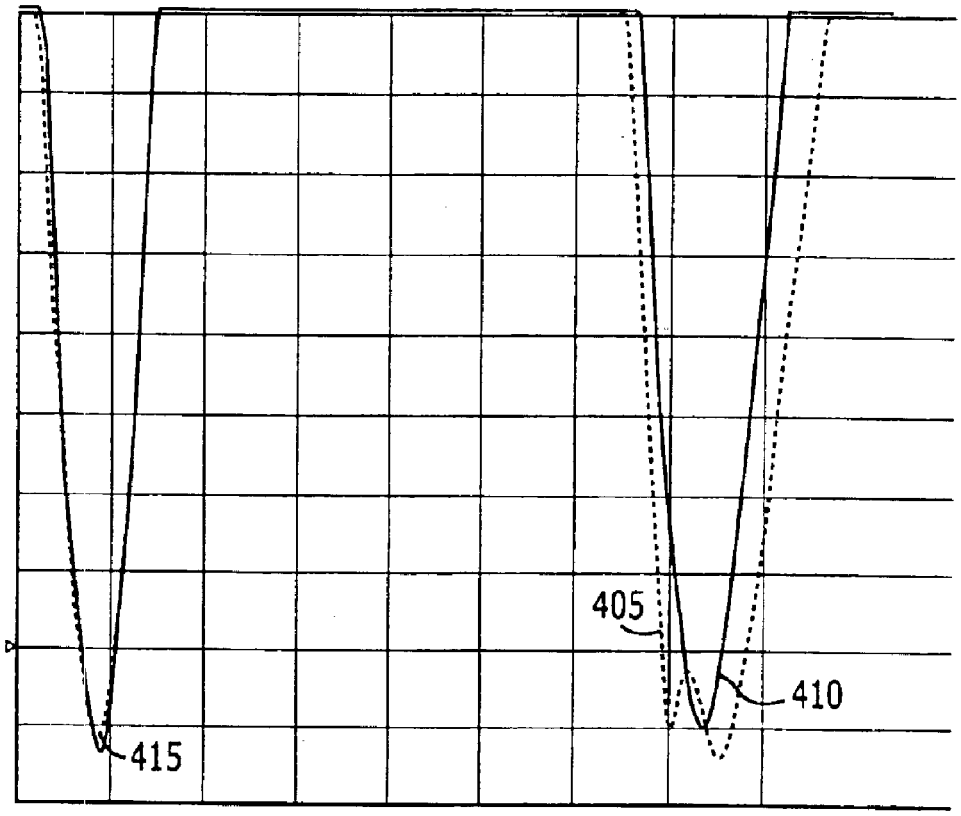
FIG. 4 is a graph that illustrates exemplary voltage standing wave ratios for multi-band planar inverted-F antennas with and without parasitic elements according to some embodiments of the invention.

FIG. 4 is a graph that illustrates exemplary performance of planar inverted-F antennas including floating parasitic elements according to embodiments of the invention. According to FIG. 4, the floating parasitic element 340 can provide a first component of a signal, for example, in a lower range of frequencies in the first frequency band. A second component of the signal (at an upper range of frequencies of the first frequency band) can be provided by the first planar inverted-F antenna branch 305. In particular, a lower end of VSWR trace 405 associated with a lower range of frequencies within the first frequency band can be provided by the floating parasitic element 340 shown in FIG. 3. Moreover, the first planar inverted-F antenna branch 305 can resonate as described above provide an upper end of VSWR 405 associated with an upper range of frequencies included in the first frequency band. Taken together, the respective resonances of the floating parasitic element 340 and the first planar inverted-F antenna branch 305 can provide a reduced VSWR for the first frequency band of about 2.5:1. For comparison, FIG. 4 shows exemplary performance of a conventional multi-band antenna without a floating parasitic element according to the invention. In particular, VSWR trace 410 associated with the conventional multi-band antenna is in a range between about 3.3:1 and about 3.5:1.

Figure 5:
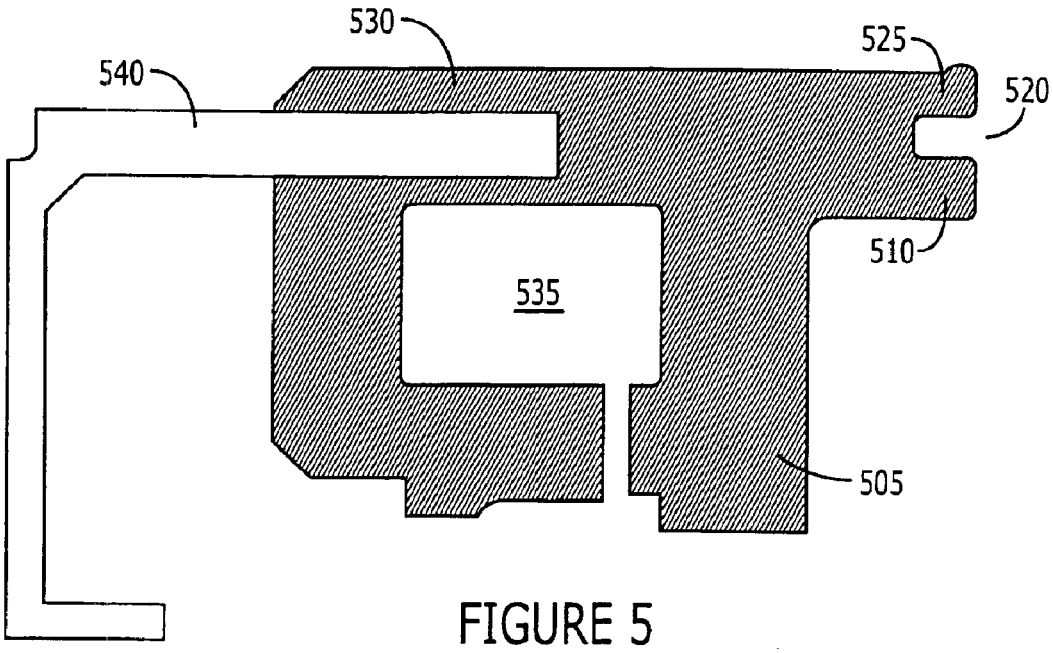
FIGS. 5 and 6 are plan views that illustrate some embodiments of multi-band planar inverted-F antennas according to the invention.

FIG. 5 is a plan view that illustrates embodiments of multi-band planar inverted-F multi-band antennas according to the invention. A floating parasitic element 540 is located above a second planar inverted-F antenna branch 530 and is ohmically isolated from the second planar inverted-F antenna branch 530. The second planar inverted-F antenna branch 530 and a first planar inverted-F antenna branch 505 define an open region 535 therebetween. Furthermore, the floating parasitic element 540 at least partially overlaps the second planar inverted-F antenna branch 530. In other embodiments according to the invention, the floating parasitic element 540 can be located beneath the second planar inverted-F antenna branch 530 between a ground plane and the second planar inverted-F antenna branch 530. The placement of the floating parasitic element 540 above or below the second planar inverted-F antenna branch 530 can increase the electromagnetic coupling therebetween. An RF feed 510 is located on a portion 520 of the multi-band planar inverted-F multi-band antenna. A ground contact 525 is located on the portion 520 spaced-apart from the RE feed 510.

Figure 6:
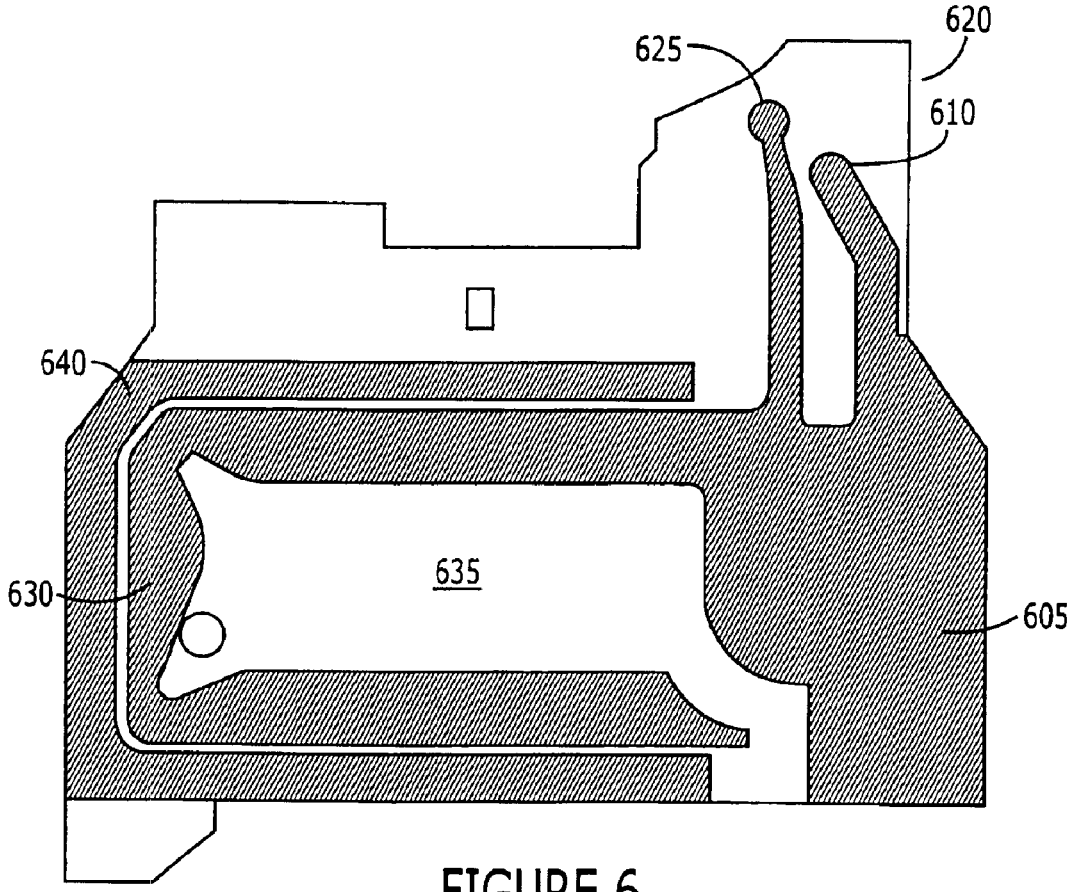

FIG. 6 is a plan view that illustrates embodiments of planar inverted-F antennas according to the invention. In particular, FIG. 6 illustrates a first planar inverted-F antenna branch 605 that resonates in two frequency bands, such as a first band of about 1710 MHz to about 1850 MHz and a second band of about 1850 MHz to about 1990 MHz. A second planar inverted-F antenna branch 630 extends in first, second and third directions to define an open region 635 that is at least partially enclosed by the second planar inverted-F antenna branch 630. The second planar inverted-F antenna branch 630 can resonate in a third frequency band such as about 824 MHz to about 960 MHz. A floating parasitic element 640 is spaced apart from and is ohmically isolated from the second planar inverted-F antenna branch 630. Furthermore, the floating parasitic element 640 is configured to electromagnetically coupled to the second planar inverted-F antenna branch 630 as described above in reference to FIGS. 3–5. An RF feed 610 is located on a portion 620 of the multi-band planar inverted-F multi-band antenna. A ground contact 625 is located on the portion 620 spaced-apart from the RF feed 610.

As described herein, in some embodiments according to the invention, a multi-band antenna can be can be a multi-band planar inverted-F antenna that includes a floating parasitic element. For example, a planar inverted-F antenna according to the invention can include first and second planar inverted-F antenna branches that extend on a dielectric substrate. The first planar inverted-F antenna branch can be configured to resonate in response to first electromagnetic radiation in a first frequency band. The second planar inverted-F antenna branch can be configured to resonate in response to second electromagnetic radiation in a second frequency band.

The floating parasitic element can be configured to electromagnetically couple to the second planar inverted-F antenna branch when, for example, the second planar inverted-F antenna branch is excited by the electromagnetic radiation provided via an RF feed (when the antenna is used to transmit). The floating parasitic element is also configured to electromagnetically couple to the second planar inverted-F antenna branch when the floating parasitic element is excited by electromagnetic radiation provided via free-space.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed:

1. A multi-band antenna comprising:

a first planar inverted-F antenna branch configured to resonate in response to first electromagnetic radiation in a first frequency band;

a second planar inverted-F antenna branch configured to resonate in response to second electromagnetic radiation in a second frequency band that is less than the first frequency band; and a floating parasitic element ohmically isolated from the second planar inverted-F antenna branch and configured to resonate in the first frequency band.

2. A multi-band antenna according to claim 1 wherein the floating parasitic element is coplanar with the second planar inverted-F antenna branch.

3. A multi-band antenna according to claim 1 wherein the floating parasitic element is beneath and at least partially overlaps the second planar inverted-F antenna branch.

4. A multi-band antenna according to claim 3 wherein the floating parasitic element is between a ground plane and the second planar inverted-F antenna branch.

5. A multi-band antenna according to claim 1 wherein the first and second planar inverted-F antenna branches extend in a first direction to partially enclose an open region.

6. A multi-band antenna according to claim 5 wherein the second planar inverted-F antenna branch is between the floating parasitic element and the open region.

7. A multi-band antenna according to claim 6 wherein the second planar inverted-F antenna branch extends in first and second directions and the floating parasitic element extends in the first and second directions.

8. A multi-band antenna according to claim 1 herein the first planar inverted-F antenna branch is configured to provide a first signal component in a first frequency range of the first frequency band; and wherein the floating parasitic element is configured to resonate to provide a second signal component in the first frequency band in a second frequency range in the first frequency band that overlaps the first frequency range to provide a Voltage Standing Wave Ratio for the multi-band antenna assembly in the first frequency band of about 2.5:1.

9. A multi-band antenna according to claim 1 further comprising:

a dielectric substrate having the first and second planar inverted-F antenna branches mounted thereon, the first and second planar inverted-F antenna branches coupled to one another at a proximal portion of the dielectric substrate.

10. A multi-band antenna according to claim 9 further comprising:

an RE feed coupled to the first and second planar inverted-F branches at the proximal portion of the dielectric substrate; and a ground contact spaced apart from the RF feed.

11. A multi-band antenna according to claim 1 wherein the first frequency band includes frequencies in a range between about 1710 MHz and about 1990 MHz.

12. A multi-band antenna according to claim 1 wherein the second frequency band includes frequencies in a range between about 824 MHz and about 960 MHz.

13. A multi-band antenna according to claim 1 wherein the multi-band antenna is located in a cavity of a housing of a wireless terminal.

14. A multi-band antenna according to claim 1 wherein the multi-band antenna is configured to couple to an exterior of a housing of a wireless terminal.

15. A multi-band wireless terminal comprising:

a housing that defines a cavity inside the housing;

a transceiver, positioned within the cavity, that receives multi-band and wireless communications signals and that transmits multi-band wireless communications signals; and a multi-band antenna in the cavity comprising a first planar inverted-F antenna branch configured to resonate in response to first electromagnetic radiation in a first frequency band;

a second planar inverted-F antenna branch configured to resonate in response to second electromagnetic radiation in a second frequency band that is less than the first frequency band; and a floating parasitic element ohmically isolated from the second planar inverted-F antenna branch and configured to resonate in the first frequency band.

16. A multi-band wireless terminal according to claim 15 wherein the floating parasitic element is coplanar with the second planar inverted-F antenna branch.

17. A multi-band wireless terminal according to claim 15 wherein the first and second planar inverted-F antenna branches extend in a first direction to partially enclose an open region.

18. A multi-band wireless terminal according to claim 17 wherein the second planar inverted-F antenna branch is between the floating parasitic element and the open region.

19. A multi-band wireless terminal according to claim 15 wherein the second planar inverted-F antenna branch extends in first and second directions and the floating parasitic element extends in the first and second directions.

20. A multi-band wireless terminal according to claim 15 wherein the first planar inverted-F antenna branch is configured to provide a first signal component in a first frequency range of the first frequency band; and wherein the floating parasitic element is configured to resonate to provide a second signal component in the first frequency band in a second frequency range in the first frequency band that overlaps the first frequency range to provide a Voltage Standing Wave Ratio for the multi-band antenna assembly in the first frequency band of about 2.5:1.

21. A multi-band wireless terminal according claim 15 wherein the first frequency band includes frequencies in a range between about 1710 MHz and about 1990 MHz.

22. A multi-band wireless terminal according to claim 15 wherein the second frequency band includes frequencies in a range between about 824 MHz and about 960 MHz.

23. A multi-band antenna comprising:

a first planar inverted-F antenna branch configured to resonate in response to first electromagnetic radiation in a first frequency band;

a second planar inverted-F antenna branch configured to resonate in response to second electromagnetic radiation in a second frequency band that is less than the first frequency band; and a floating parasitic element ohmically isolated from and coplanar with the second planar inverted-F antenna branch and configured to electromagnetically couple to the second planar inverted-F antenna branch.

24. A multi-band antenna according to claim 23 wherein the floating parasitic element is shaped to substantially follows an outer contour of the second planar inverted-F antenna branch.

25. A multi-band antenna according to claim 23 wherein the floating parasitic element is configured to resonate in the first frequency band.

* * * * *

UNITED STATES PATENT AND TRADEMARK OFFICE

CERTIFICATE OF CORRECTION

PATENT NO. : 6,943,733 B2
DATED : September 13, 2005
INVENTOR(S) : Vance

It is certified that error appears in the above-identified patent and that said Letters Patent is hereby corrected as shown below:

Column 9,
Line 24, should read -- 8. A multi-band antenna according to claim 1 wherein the --.
Line 63, should read -- multi-band wireless communications signals and --.

Signed and Sealed this

Twenty-first Day of February, 2006

JON W. DUDAS
*Director of the United States Patent and Trademark Office*